US007913424B1

(12) United States Patent
Raith et al.

(10) Patent No.: US 7,913,424 B1
(45) Date of Patent: Mar. 29, 2011

(54) FOOTWEAR

(75) Inventors: Paul Edmund Raith, Haan (DE); Liviu-Mihai Pavelescu, München (DE)

(73) Assignee: Sympatex Technologies GmbH, Unterfohring (DE)

( * ) Notice: Subject to any disclaimer, the term of this patent is extended or adjusted under 35 U.S.C. 154(b) by 0 days.

(21) Appl. No.: 12/991,622

(22) PCT Filed: May 25, 2009

(86) PCT No.: PCT/EP2009/056259
§ 371 (c)(1),
(2), (4) Date: Nov. 8, 2010

(87) PCT Pub. No.: WO2009/141445
PCT Pub. Date: Nov. 26, 2009

(30) Foreign Application Priority Data

May 23, 2008 (DE) ..... 10 2008 024 959

(51) Int. Cl.
*A43B 23/07* (2006.01)

(52) U.S. Cl. ..... 36/55; 36/10; 36/48

(58) Field of Classification Search ..... 36/55, 10, 36/47–49
See application file for complete search history.

(56) References Cited

U.S. PATENT DOCUMENTS

| | | | | |
|---|---|---|---|---|
| 2,339,057 | A * | 1/1944 | Crofut, Jr. | 36/10 |
| 2,376,398 | A * | 5/1945 | Steffanson | 36/10 |
| 2,628,438 | A * | 2/1953 | Luchs | 36/10 |
| 2,919,503 | A * | 1/1960 | Sholovitz | 36/9 R |
| 3,289,330 | A * | 12/1966 | Trachsel et al. | 36/48 |
| 4,649,656 | A | 3/1987 | Cox et al. | |
| 5,167,084 | A | 12/1992 | Flammier | |
| 2003/0061737 | A1 | 4/2003 | Zhu | |
| 2004/0205982 | A1 | 10/2004 | Challe | |

FOREIGN PATENT DOCUMENTS

| | | | |
|---|---|---|---|
| DE | 40 32 826 | A1 | 5/1991 |
| DE | 40 16 217 | A1 | 11/1991 |
| EP | 1 468 621 | A1 | 10/2004 |

OTHER PUBLICATIONS

Nov. 25, 2009 International Search Report issued in Application No. PCT/EP2009/056259.

* cited by examiner

*Primary Examiner* — Ted Kavanaugh
(74) *Attorney, Agent, or Firm* — Oliff & Berridge, PLC

(57) ABSTRACT

A shoe structure having an exterior upper, an interior upper, an insole and an outsole. The interior upper has an upper opening with a peripheral edge at the upper end of the interior upper and a lower opening with a peripheral edge at the lower sole-side end of the interior upper, with the interior upper also having a rear or heel area, two side areas and a front area with a seam running between the upper and lower openings. The seam runs from the upper opening on the one side over the front area to the lower opening on the other side.

8 Claims, 5 Drawing Sheets

FOOTWEAR

BACKGROUND

The disclosure relates to a shoe structure comprising an exterior upper, an interior upper, an insole and an outsole.

In shoes commercially available today, the interior upper consists in its simplest form of a single formed part whose ends are sewn together on the front side of the interior upper. As a result of this seam, the upper end of the interior upper and the lower sole-side end of the interior upper each form an opening, and the interior upper is given its form which follows the form of the upper material or the exterior upper. The seam runs roughly along the middle of the front interior upper area, i.e. along the middle of the forefoot and instep area, from the upper opening to the lower opening of the interior upper.

During the make-up of the shoe, the upper of the shoe which can comprise an interior upper and an exterior upper is drawn over a last and—depending on the design—lasted under the insole, i.e. is joined to the insole. As the prior-art one-piece interior upper has only a very limited stretchability along the seam that runs roughly along the middle of the front area of the interior upper from the upper to the lower interior upper opening, drawing of the interior upper over the last and subsequent lasting is extremely difficult or not possible at all.

As an alternative to one-piece interior uppers, a person skilled in the art will also be familiar with two-piece interior uppers which have a separate leaf in the front part of the interior upper that is joined to the interior upper by a seam which runs at right-angles to the forefoot area. A further alternative to the one-piece interior upper described is a two-piece interior upper with an insert that extends over the front area of the interior upper from the upper to the lower interior upper opening with the insert being joined to the interior upper by two lateral seams.

Although such two-piece interior upper constructions have the necessary stretchability in the front area of the interior upper and can therefore be easily drawn over the last, the time involved in producing two-piece interior upper constructions is significantly greater, so that the two-piece interior uppers are significantly more expensive to produce than one-piece interior uppers.

SUMMARY

The object of embodiments is therefore to provide a shoe structure comprising an exterior upper, an interior upper, an insole and an outsole and whose interior upper construction at least reduces the disadvantages of the prior art.

BRIEF DESCRIPTION OF THE DRAWINGS

The invention is described in greater detail by reference to the following figures.

DETAILED DESCRIPTION OF EMBODIMENTS

Figure 1:
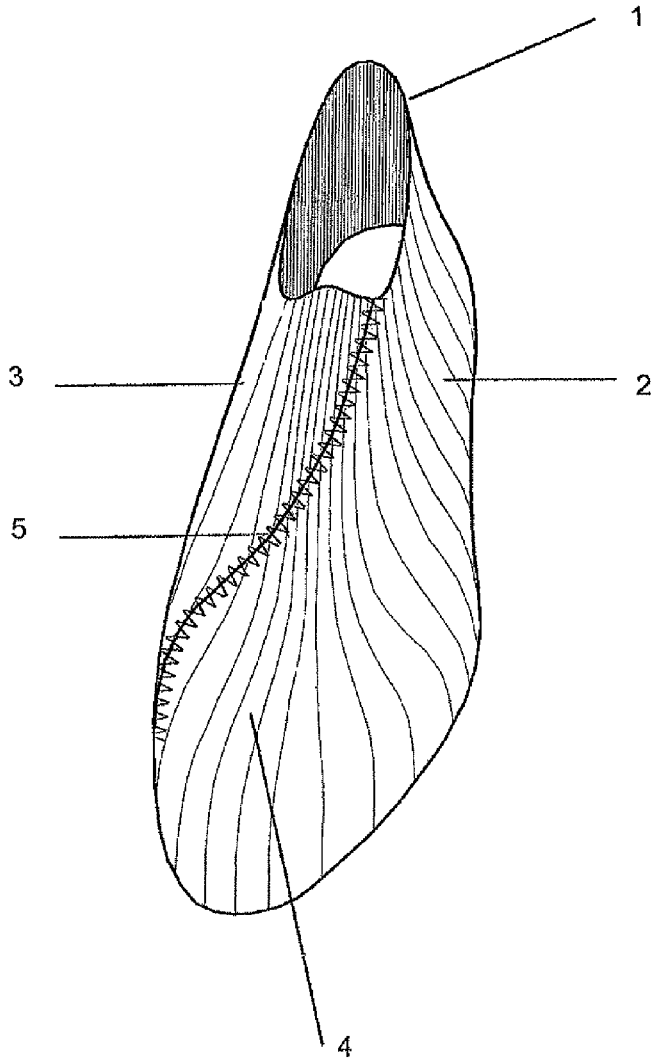
FIG. 1 shows the interior upper of embodiments of the shoe structure.

The object of the present disclosure may be achieved by a shoe structure comprising an exterior upper, an interior upper, an insole and an outsole with the interior upper having an upper opening with a peripheral edge at the upper end of the interior upper and a lower opening with a peripheral edge at the lower sole-side end of the interior upper, and with the interior upper having a rear or heel area, two side areas and a front area with a seam running between the upper and lower openings, wherein the seam runs from the upper opening of the one side area over the front area to the lower opening of the other side area.

With an interior upper such as that used in shoes commercially available today, the necessary stretchability in the front area of the interior upper can only be achieved by the interior upper having a separate leaf or an insert in the front area. Such interior uppers necessitate several seams in the front area that run between the upper and lower openings and/or at right-angles across the front area from one side of the interior upper to the other. The interior upper of embodiments of the shoe structure requires only one seam in the front area and is therefore not only simple to produce but also—despite having only one seam in the front area—very surprisingly exhibits the necessary stretchability in the front area to allow the interior upper to be drawn over the last.

The interior upper of embodiments may exhibit a seam that runs from the upper opening of the one side area essentially diagonally across the front area of the interior upper to the lower opening of the other side area.

The form of the seam also allows the interior upper to be made in one piece.

In embodiments, the interior upper is a one-piece interior upper. In embodiments, the interior upper comprises a single formed part whose ends are joined by a seam in such a way that the upper end of the interior upper and the lower sole-side end of the interior upper each form an opening, and the interior upper is given its form which follows the form of the upper material or the exterior upper. The seam runs here from the upper opening of the one side area over the front area to the lower opening of the other side area of the interior upper. Surprisingly this ensures good stretchability of the interior upper in the forefoot area in both the longitudinal and transverse directions with a one-piece interior upper having only one seam.

In embodiments, the shoe structure is a watertight, water vapour permeable shoe structure. The watertight, water vapour permeable properties are achieved with a functional layer. This functional layer can lie between the interior upper and the exterior upper, or be laminated to the inside of the exterior upper. In a particularly preferred embodiment of the inventive shoe structure, the interior upper comprises a lining material and a watertight, water vapour permeable functional layer, said functional layer being laminated to the textile lining material.

FIG. 1 shows one embodiment of an interior upper of the shoe structure, with the interior upper having a rear or heel area 1, two side areas 2 and 3 and a front area 4 with a seam 5 running between the upper opening of the interior upper and the lower opening of the interior upper. The interior upper illustrated is a one-piece interior upper. The seam 5 runs from the upper opening of the one side area 2 over the front area 4 to the lower opening of the other side area 3.

Figure 2:
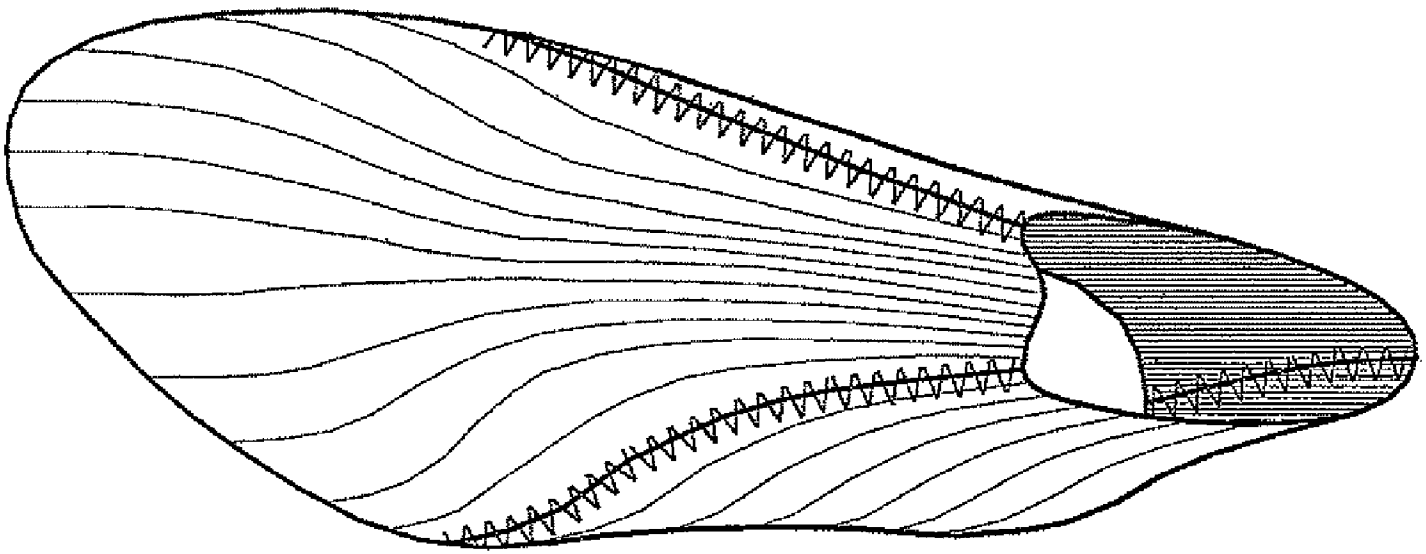
FIG. 2 shows the interior upper of a prior-art shoe structure.

FIG. 2 shows an interior upper of a prior-art shoe structure of three-piece design, which has an insert in its front area that extends over the front area of the interior upper from the upper opening of the interior upper to the lower opening, with the insert being joined to the interior upper by two lateral seams.

Figure 3:
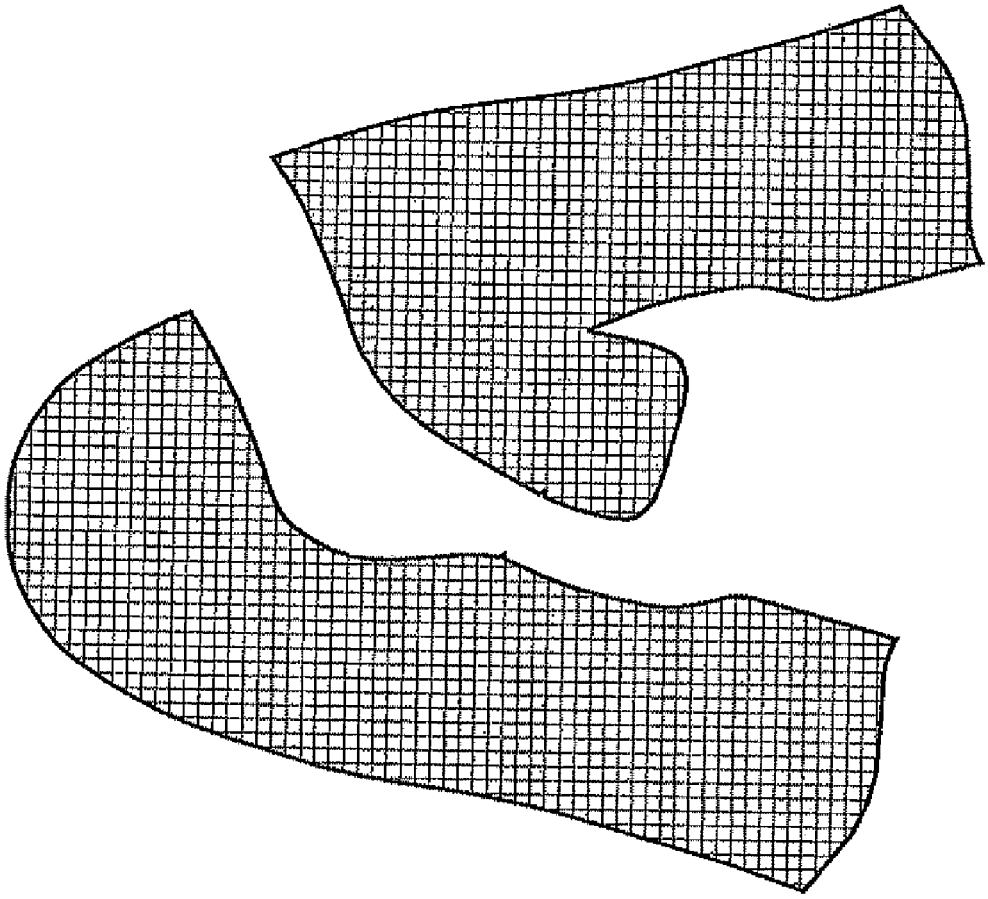
FIG. 3 shows a cutting pattern of a two-piece interior upper for the embodiments of the shoe structure.

FIG. 3 shows embodiments of a cutting pattern of two formed parts that can be joined to form an interior upper for the inventive shoe structure. The formed parts are joined by a seam in the heel area 1 and a seam that runs from one side area over the front area to the other side area such that after joining with the seams they form an interior upper.

Figure 4:
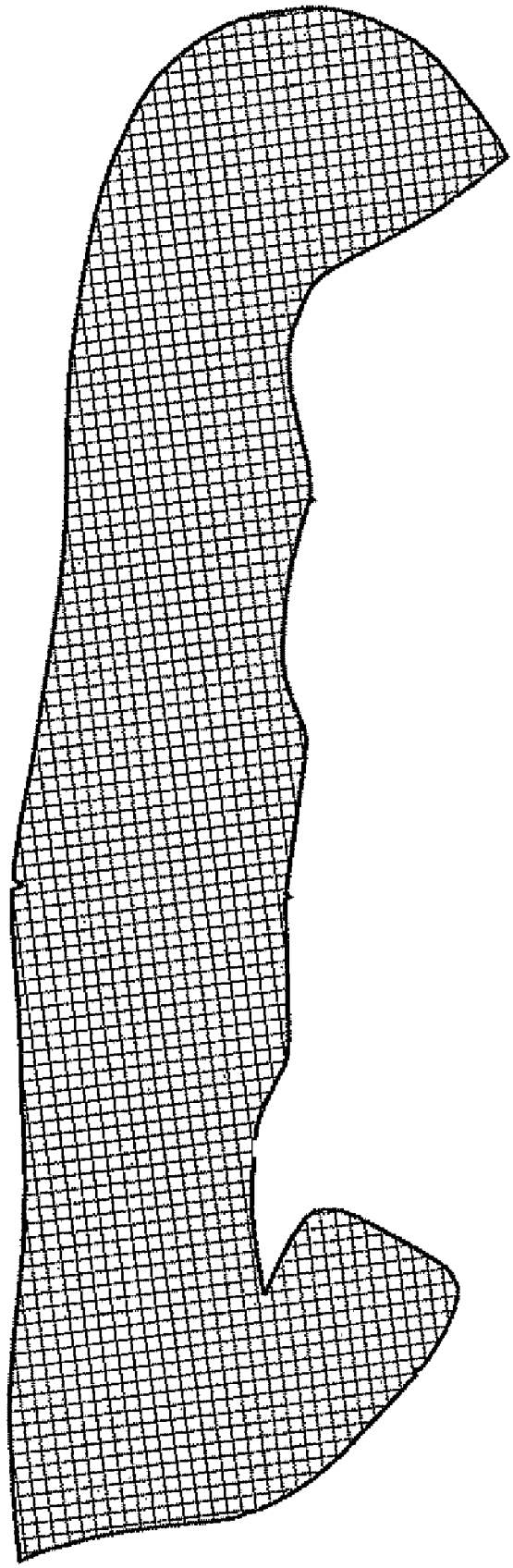
FIG. 4 shows a cutting pattern of a one-piece interior upper for embodiments of the shoe structure.

FIG. 4 shows embodiments of a cutting pattern of a formed part from which a one-piece interior upper for the inventive shoe structure can be produced. After joining with a seam from one side area over the front area to the second side area, a one-piece interior upper is formed with a single seam, which, as shown in FIG. 1, runs from the upper opening of the one side area over the front area to the lower opening of the other side area.

Figure 5:
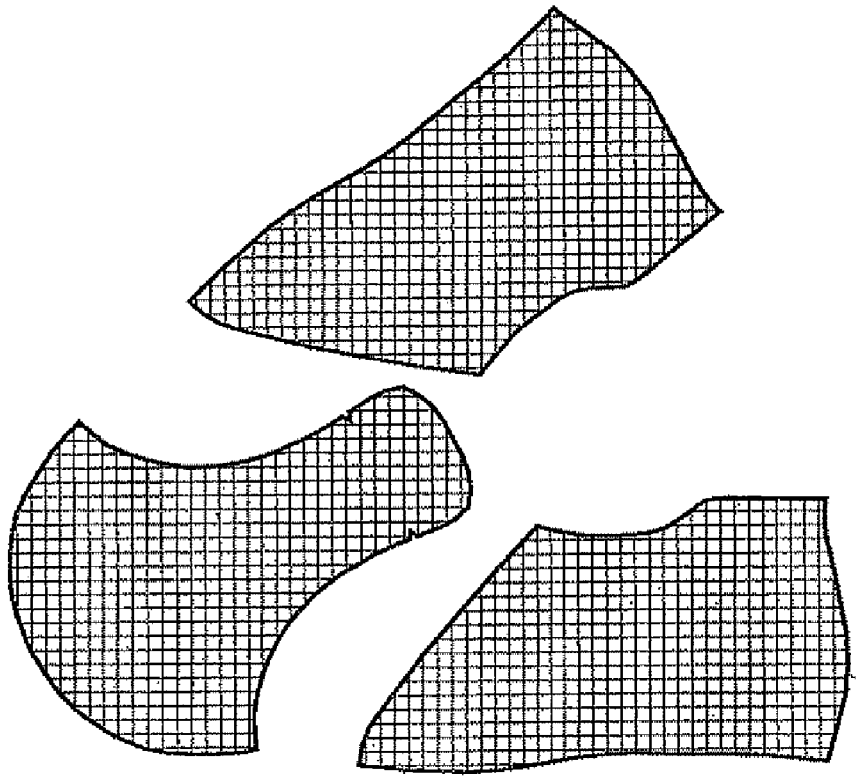
FIG. 5 shows a cutting pattern of a three-piece interior upper for a prior-art shoe structure.

FIG. 5 shows embodiments of a cutting pattern of three formed parts from which a prior-art interior upper can be produced. Such an upper consists of two side parts and one insert with the side parts being joined in the heel area by one seam and in the front area by one seam each to the insert so that an interior upper as illustrated in FIG. 2 is formed.

The invention claimed is:

1. A shoe structure comprising an exterior upper, an interior upper, an insole and an outsole, the interior upper comprising:

an upper opening with a peripheral edge at an upper end of the interior upper, a lower opening with a peripheral edge at a lower sole-side end of the interior upper, a rear or heel area, a first side area and a second side area, and a front area with a seam running between the upper opening of the interior upper and the lower opening of the interior upper, wherein the seam runs from the upper opening of the first side area, over the front area and to the lower opening of the second side area.

2. The shoe structure according to claim 1, wherein the seam runs essentially diagonally over the front area of the interior upper.

3. The shoe structure according to claim 2, wherein the interior upper is a one-piece interior upper.

4. The shoe structure according to claim 3, wherein the interior upper comprises a lining material and a watertight, water vapour permeable functional layer.

5. The shoe structure according to claim 2, wherein the interior upper comprises a lining material and a watertight, water vapour permeable functional layer.

6. The shoe structure according to claim 1, wherein the interior upper is a one-piece interior upper.

7. The shoe structure according to claim 6, wherein the interior upper comprises a lining material and a watertight, water vapour permeable functional layer.

8. The shoe structure according to claim 1, wherein the interior upper comprises a lining material and a watertight, water vapour permeable functional layer.

* * * * *